United States Patent [19]

Wroblewski

[11] 4,368,407

[45] Jan. 11, 1983

[54] INDUCTOR-CAPACITOR IMPEDANCE DEVICES AND METHOD OF MAKING THE SAME

[75] Inventor: Theodore Wroblewski, Danvers, Mass.

[73] Assignee: Frequency Technology, Inc., Littleton, Mass.

[21] Appl. No.: 71,706

[22] Filed: Aug. 31, 1979

[51] Int. Cl.[3] ..... H01F 27/28

[52] U.S. Cl. ..... 315/291; 29/25.42; 29/602 R; 336/223; 361/270

[58] Field of Search ..... 315/239, 243, 244, 276, 315/283, 291; 361/270; 336/69, 183, 223; 29/25.42, 602 R, 605

[56] References Cited

U.S. PATENT DOCUMENTS

| | | | |
|---|---|---|---|
| 2,521,513 | 9/1950 | Gray | 315/243 |
| 3,086,184 | 4/1963 | Nichols | 336/223 X |
| 3,891,955 | 6/1975 | Horton | 336/223 X |
| 3,911,332 | 10/1975 | Kunkel | 361/270 |

*Primary Examiner*—Eugene R. LaRoche
*Attorney, Agent, or Firm*—Cesari & McKenna

[57] ABSTRACT

An improved inductor-capacitor device and a power regulating circuit incorporating said improved device, the improvement including integrally formed terminals on the conducting foil which are supported by the dielectric insulating material that separates the strips of conducting foil, and the setting of the foil windings in a rigid structure by interlaying between each foil strip an insulating strip of dielectric material that is coated with a high temperature thermosetting or thermoplastic bonding cement having physical properties similar to the dielectric material. Two improved inductor-capacitor devices are interconnected in a power regulating circuit for a discharge lamp device wherein their separate capacitive and inductive reactance are combined, each device being connected in such a manner to more uniformly distribute current through the conducting layer of each device.

8 Claims, 11 Drawing Figures

INDUCTOR-CAPACITOR IMPEDANCE DEVICES AND METHOD OF MAKING THE SAME

BACKGROUND OF THE INVENTION

This invention concerns improvements in dry inductor-capacitor devices and a method for making the same. Additionally, this invention relates to series impedance circuits that include a voltage level regulating or a power regulating inductor-capacitor unit for gaseous discharge lamps.

A typical dry inductor-capacitor device, also known as a cap-reactor, comprises at least two strips of conducting foil which are separated by a thin layer of dielectric material. These strips are rolled together to form a coil-like unit and electrical terminals are affixed at the start end of one foil and the finish end of the other foil. When used in alternating current regulating circuits, an inductive reactance component is established by parallel current flow through both layers of foil in a direction of the coil. A capacitive reactance component is established by displacement current flow normal to the surfaces of the conducting foils. A magnetically permeable iron core may be inserted in the center of the coil form to increase the inductive reactance component. These types of devices are generally more desirable for providing impedance in power regulating circuits because of their relatively smaller size and weight than comparable impedance devices comprising separate inductor and capacitor elements.

An example of such an inductor-capacitor device and at least one explanation of their theory of operation is described in U.S. Pat. No. 2,521,513 issued to Gray.

In the design and construction of these inductor-capacitor units, the acquisition of good mechanical integrity is desired. Specifically, the manner of affixing connection terminals to the foils has previously presented some difficulties. Usually, an electrical terminal is attached to the start and/or finish end of the foils by cold welding or press fitting techniques. Since the foils are relatively thin, typically less than 0.001 inch, the often encountered bending and pulling of terminal leads during handling and use can cause the terminals to break, or cause the foil to crack near the terminal connection point. Moreover, the cold welding or press fitting of leads at the terminal juncture introduces contact resistance which may be potentially destructive to the unit. The passage of electrical current through the terminal juncture causes heat to be generated thereat which heat may destroy the unit.

Furthermore, good structural integrity also is necessary to counter a magnetomotive force that tends to displace the foils. The magnitude of this magnetomotive force is proportional to and varies with the magnitude of the current flow in the foils. When the foils are not tightly secured in the unit, conventional alternating current sources cause oscillitory movement thereof and eventual degradation of the unit. When the required current handling capability is small, the corresponding magnetomotive forces are small and the typical inductor-capacitor device may be used. However, when relatively large current handling capabilities are demanded, the typical inductor-capacitor unit rapidly degrades. Even with the use of the smaller units, this possible degradation problem has restricted the use of cap-reactors to experimental models only, as no commercially viable unit has yet been developed.

In addition to achieving mechanical and structural integrity, there are yet other difficulties that have been experienced with inductor-capacitor devices. Specifically, a phenomenon known as "current-bunching" that results from uneven magnetic fields about the conducting foils will often cause localized "hot spots" to develop in the unit. Discontinuities in the magnetic circuit resulting from gaps in the iron core tend to force the flow of charged particles to one edge of the foil. This phenomenon is not experienced in wire wound inductor coils as current flow is contained in the wires. The consequent overheating resulting from those "hot spots" ultimately cause oxidation of the foil and deterioration of the insulating dielectric. The heat produced by this excessive localized current also destroys the bonding material which holds together the unit. Some of this heat may be dissipated through radiation from an iron core. Thus, the upper limit of the current handling capability of an inductor-capacitor device, as limited by the effects of "current bunching", is established by the heat transfer characteristics of the inductor-capacitor device. The heat transfer capability is greater in dry inductor-capacitor devices than the liquid dielectric type, as the liquid dielectric, such as oil, will contain the heat in the fluid medium.

At least one solution to the difficulties that result from the "current bunching" phenomenon is to more uniformly distribute the current through the conducting foil. An example of one current distribution system is shown in U.S. Pat. No. 3,688,232 issued to Szatmari. In one example shown therein, the conducting foils vary in thickness according to their position in the coil. The starting portion of the foil that receives current is thicker, and the finish portion of the same foil is relatively thinner. Conversely, the finish portion of the second conducting foil is thicker and the start portion of that foil is relatively thin. The thicker foil portions have greater cross-sectional areas for greater current handling capabilities. Another device, disclosed in that same patent, discloses branching foil elements for handling increased current flow at certain positions in the coil unit. Obvious disadvantages of these structures are the complex assembly and fabrication requirements which may not render the device cost effective.

The minimization of leakage current that occurs between the conducting plates through the dielectric material is yet another design consideration. Leakage current is defined as a current that flows through or across the surface of insulating dielectric material and defines the insulation resistance at the specified voltage potential. In inductor-capacitor devices, increased leakage current will result in increased leakage capacitance. A proper selection of dielectric material, together with the proper selection of bonding material, can improve the optimum performance characteristics of inductor-capacitor devices. Prior art teaching, to the inventor's knowledge, to this problem has not been addressed.

Respecting circuit applications, a variety of inductor-capacitor devices have been incorporated in a variety of alternating current power regulating circuits, such as gaseous discharge lamp circuits. A unitary inductor-capacitor device, instead of separate inductive and capacitive elements, is particularly suitable in discharge lamp circuits because of their relative reduced size, weight and cost. Circuit design objectives include power factor correction, open circuit starting voltage, operating voltage and current limitation.

The open circuit starting voltage is provided by the ratio of turns between the primary winding to which the power supply is connected and the secondary winding to which the lamp device is connected. Power factor correction, a function of capacitance, is determined by the effective plate area (number of turns of foil) of the conducting foil strips and the dielectric constant of the insulating material placed therebetween. The operating voltage and current is provided by inductive reactance that is determined by the number of turns of conducting foil in series with the lamp and the magnetic reactance provided by the magnetic core material, if inserted. Thus, it can be seen that the capacitance, inductance, start-up voltage, and operating voltage characteristics of the circuit are all interplayed. A change or alteration of one parameter may necessarily effect the other parameter. Accordingly, one may propose a variety of combinations of the several parameters in the design of regulating circuits for discharge lamp devices.

Once having established the design parameters of an inductor-capacitor device that possesses the required current handling capabilities, further innovation is necessary to produce an electrical impedance circuit having desired performance characteristics. It is desirable to choose an inductor-capacitor circuit that allows flexibility in selecting the physical parameters so that one may conveniently meet power factor correction, open circuit voltage, operating voltage, and current limitation.

In view of the foregoing, it is an object of this invention to provide an improved inductor-capacitor device and a method for making the same.

Another object of this invention is to provide an improved lamp ballast power regulating circuit incorporating an improved inductor-capacitor device.

Another object of this invention is to provide an inductor-capacitor device having terminals that are more durable than prior art units by integrally forming terminals on the conducting foil.

Another object of this invention is to provide a dry inductor-capacitor device having a greater mechanical integrity than prior art devices.

Another object of this invention is to provide an inductor-capacitor device that possesses improved heat transfer characteristics and current distribution through the conducting foil.

A further object of this invention is to provide an inductor-capacitor device having a higher power handling capability than prior art devices.

It is yet another object of this invention to provide an inductor-capacitor device in a power regulating circuit for a discharge lamp wherein greater flexibility in selecting physical parameters of the device are afforded.

Further, an additional object of the invention will become more readily apparent upon review of the succeeding disclosure taken in connection with the accompanying drawings.

SUMMARY OF THE INVENTION

In accordance with one aspect of this invention, an inductor-capacitor device comprises two strips of conducting foil separated by strips of insulating dielectric material. The dielectric material is coated on each side thereof with a thermosetting or thermoplastic bonding cement that has dielectric properties similar to that of the dielectric material. The strips of conducting foil and dielectric material are pressed together, rolled into a coil form, and heated to set the unit in a rigid unitary structure. Integral terminals are formed at respective ends of the foil strips by extending the foil, and then folding over, at two locations or more, an end portion of the foil to sandwich therebetween the dielectric material. The dielectric material acts as a backing for the thin foil to support its relatively thin and fragile element.

In accordance with a second aspect of the invention, a power regulating circuit for a gaseous discharge lamp comprises first and second inductor-capacitor devices which are magnetically coupled to a primary winding that is connected to a source of alternating current power. Respective foil windings of each of the first and second inductor-capacitor devices are electrically interconnected to distribute the current more evenly through both layers of each inductor-capacitor winding. The discharge lamp has connected at one of its terminals a source of power, and at its other terminal, one terminal of one inductor-capacitor winding.

The invention is pointed out with particularity in the appended claims. The above and further objects and advantages of this invention will be better understood by referring to the following description taken in connection with the accompanying drawings.

DESCRIPTION OF AN ILLUSTRATIVE EMBODIMENT

Figure 1A:
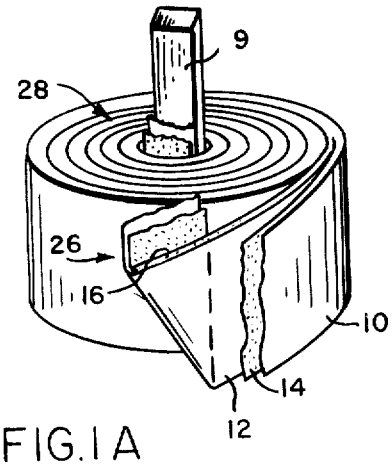
FIG. 1A shows a perspective view of an inductor-capacitor unit that incorporates the improvement of this invention.
Figure 1B:
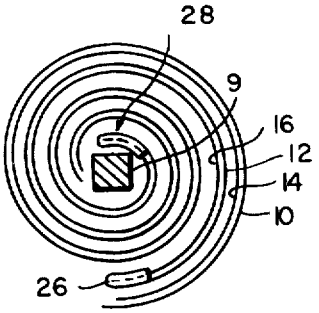
FIG. 1B shows a top elevational and spaced apart view of the inductor-capacitor coil of FIG. 1A.

Referring to FIGS. 1A and 1B, an inductor-capacitor device includes a pair of conducting foil strips 10 and 12 separated by a pair of insulating strips of dielectric material 14 and 16. The unit is shown in a spaced apart relationship for illustration purposes only. The actual device is a tightly wound compact unit. In the preferred embodiment, the conducting foil is composed of aluminum or copper and the dielectric material is composed of mylar or similar material. Other conducting foil and dielectric materials also may be used. Terminals are integrally formed at a start end 26 of the foil/dielectric pair 12–16, and at a finish end 28 of the foil/dielectric pair 10–14. Both capactive and inductive reactances are provided between terminals 26 and 28. This reactance is increased by inserting a magnetic core 9 in the hollow core the of coil-like unit. When a voltage potential is applied across the terminals 26 and 28, current flows in parallel path along both foils 10 and 12 from one terminal end to the other end. There is a constant difference of electrical potential between the foils 10 and 12 along their length. One foil picks up current along its length while the other foil loses current in the same corresponding direction while all current flows through each of the respective terminals 26 and 28. Thus, the portion of the foil at the terminal ends 26 and 28 will carry all the current while the opposed ends of each of the respective foils will carry no current. In the circuit arrangement described subsequently, this current is more evenly distributed throughout both of the conducting foils.

Now, when the device is used as a transformer winding wherein the primary and secondary foil windings are closely coupled, there exists, by virtue of coupling effect, a more uniform distribution of current flow in each turn of the foils, yet all current still flows through the start and finish ends. Thus, with the distributed current flow, rather than the increasing/decreasing current flow as previously explained, there is less localized heat generation within the unit.

Figure 2A:
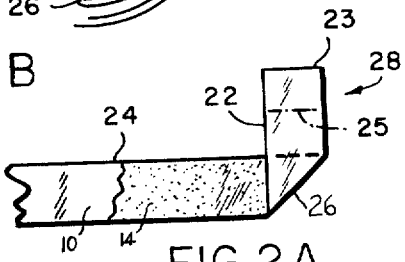
FIG. 2A shows the foil-dielectric strip in illustration of a preliminary step in the forming of an integral terminal at an end thereof.
Figure 2B:
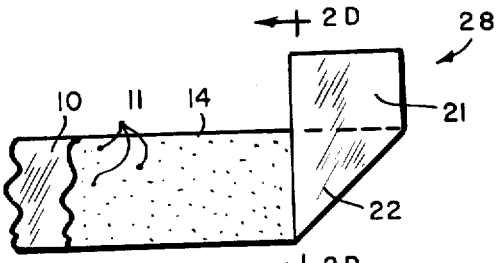
FIGS. 2B and 2C show front and back elevational views of the foil-dielectric strip after having been manipulated by a subsequent step in forming the integral terminal at the end thereof.
Figure 2C:
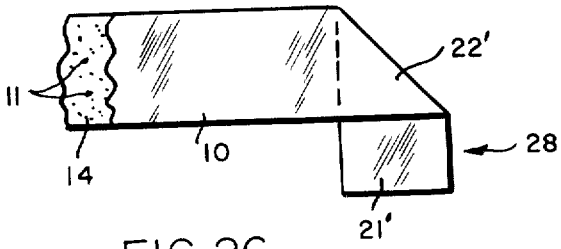
Figure 2D:
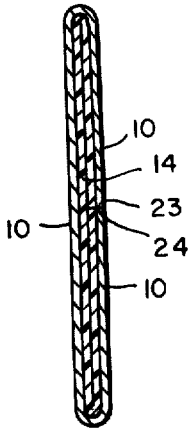
FIG. 2D shows a cut-away view taken at 2D—2D of FIG. 2B and depicts the dielectric material sandwiched between the conducting foil.

Now, referring specifically to FIG. 2A, the connector terminal 28 of FIG. 1B comprising foil/dielectric pair 10–14 is integrally formed by firstly folding over a portion of the foil/dielectric pair 22 at edge 26 and then folding over said portion again at crease 25 so that edge 23 abuts edge 24 so as to sandwich therebetween the dielectric insulating material 14. FIGS. 2B and 2C show the resulting integral terminal. The relatively thin conducting foil having the mylar backing may then provide an electrical contact surface of sufficient strength to support a contact or welded connector. This improved terminal can better withstand the often encountered bending and stresses often associated with terminals. The contact surface may be folded over several more times to increase its thickness for increased strength. A cut-away portion indicated by line 2D—2D of FIG. 2B is shown in FIG. 2D wherein the terminal end includes conducting foil 10 on both sides of the terminal structure with dielectric material 14 sandwiched between the two layers of conducting foil. A typical thickness for the conducting foil is 0.00035 inches and a typical thickness for the dielectric material is 0.0005 inches. These thicknesses permit a relatively large number of turns to be contained in a relatively small volume, while also providing the minimum workable foil strength for handling during fabrication and assembly.

Figure 2E:
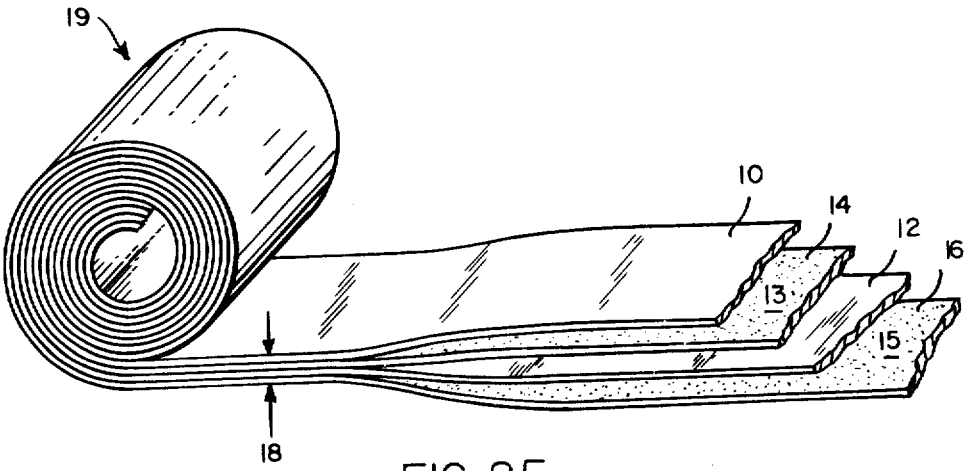
FIG. 2E illustrates yet another step in the process of forming the inductor-capacitor device that includes bonding by pressing together the layers and rolling of the bonded layers to form the coil.

Prior to assembly, each of the dielectric strips are coated on both sides thereof with a high temperature thermosetting or thermoplastic bonding cement that has a dielectric property and other physical properties similar to that of the dielectric material 14 and 16. In my invention, I have used a high temperature thermosetting polyester bonding cement. After the dielectric material is coated with this cement, the conducting foils are pressed contiguous thereto as illustrated in FIG. 2E, the terminal ends are formed thereon as previously indicated, and the entire structure is then rolled and formed on a mandrel into a coil-like unit, also illustrated in FIG. 2E. The cement acts to bond the respective conducting layers and to form a rigid structure. It also improves the leakage resistance properties of the dielectric material by sealing minute pores 11 of FIG. 2B that may exist in the thin mylar film. The coating of bonding cement on both sides of the mylar also obviates the requirement of using two or more sheets of dielectric material between the conducting strips for increased leakage resistance. These pores are the cause of undesirable leakage current paths existing between the foil layers. Additionally, the similarities in physical properties between dielectric material and the bonding cement provide more uniform spacing than plural dielectric layers due to entrapped air or other material.

The entire unit, after being formed, is then heated at a temperature between 110 degrees centigrade and 130 degrees centigrade for a period of time between twelve and twenty-four hours to congeal the structure. The time and temperature may vary, among other things, according to the nature of the cement and the physical size of the inductor-capacitor unit. A period of cooling then follows prior to placing the device in actual use. The inductor-capacitor unit, after having been congealed by the cement, will then have an improved seal which prevents contamination and deterioration of the foil and dielectric material caused by air and other foreign matter that may enter the structure. The type of cement selected is chosen so that the minimum breakdown temperature of the thermosetting or thermoplastic cement is at least as high as the maximum operating temperature of the inductor-capacitor device.

I use the above described inductor-capacitor devices in lamp ballast circuits for gaseous discharge devices, such as mercury vapor or sodium vapor lamps. The physical parameters of the inductor-capacitor are selected so that the open circuit voltage V, the series equivalent inductance L, and the equivalent series capacitance C meet the requirement of the desired operating conditions for the discharge lamp.

The open circuit voltage of the inductor-capacitor device must provide starting for the lamp by exciting the ions of the gases within the lamp to a level that will sustain current flow; and the series inductance and capacitance provide the necessary impedance for limiting current flow through the lamp and power factor correction, once discharge is established. A series impedance is necessary because of the negative resistance characteristics of conventional discharge lamps.

Now then, by placing the aforementioned inductor-capacitor device as described in series with a discharge lamp, an improved series impedance element for regulating the power, i.e. current flow, of high power discharge devices can be provided. The improvements include low power losses, longer life, and lower operating temperature.

Figure 3A:
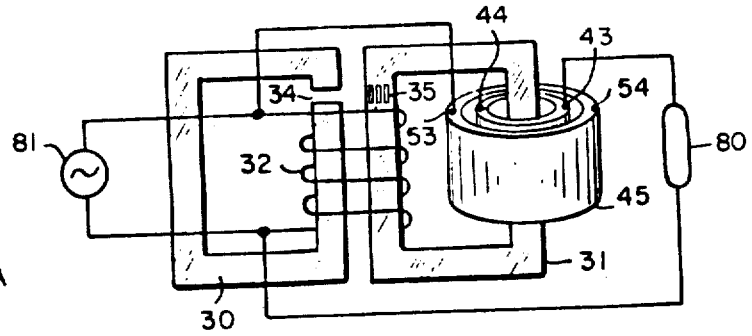
FIGS. 3A and 3B shows symbolic representations of series regulating circuit arrangements incorporating the inductor-capacitor device of this invention.

In a conventional ballast circuit having a single wire wound primary winding and a single inductor-capacitor secondary winding, the open circuit voltage V is determined by ratio of turns between the primary and secondary windings. The inductance is determined by the number of turns in the foil coil, such as coil 45 of FIG. 3A, which in part, may be controlled by the interposition of an interleaved gap 35 in the core 31 that couples the windings. Core 30, on the other hand, has an air gap 34. The effect of air gaps alters the magnetic coupling effect between the windings. The effective capacitive component of the impedance circuit is determined, inter alia, by the relationship among an area A between the surfaces of the conducting foils of symbolic coil 45, the dielectric constant K of the material therebetween, and the spacing D between the foils. The mathematical relationship is $C=(K\times A)/D$.

I have found that an additional capacitive component, under certain operating conditions, is introduced into the circuit as a result of the insertion of an iron core. When the flux density of the core is magnetically saturated, wholly or partially, the current waveform of the circuit is altered and the consequent harmonics so generated have a direct effect on the capacitive reactance. In one example, I have found that an inductor-capacitor unit had a capacitance of 7.0 micro-farads with no iron core, but the same foil winding had a capacitance of 9.6 micro-farads with an iron core inserted therein. I have found that further saturation of the iron core will further increase its capacitance with a consequent reduction in impedance, thereby further improving the cost, size, and weight of the unit. Moreover, as the impedance is reduced, the operating voltage across the unit also is reduced, and thus the unit life is increased because of a consequent lower operating temperature.

Figure 3B:
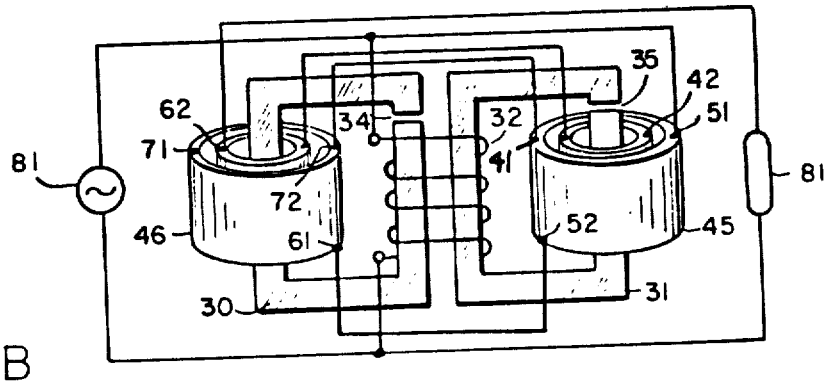
Figure 4A:
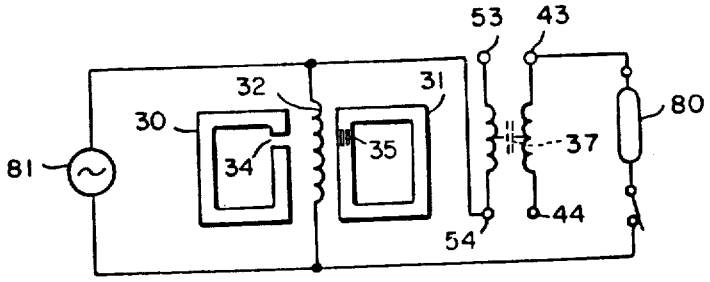
FIGS. 4A and 4B show lamp ballast circuit representations of FIGS. 3A and 3B, respectively.
Figure 4B:
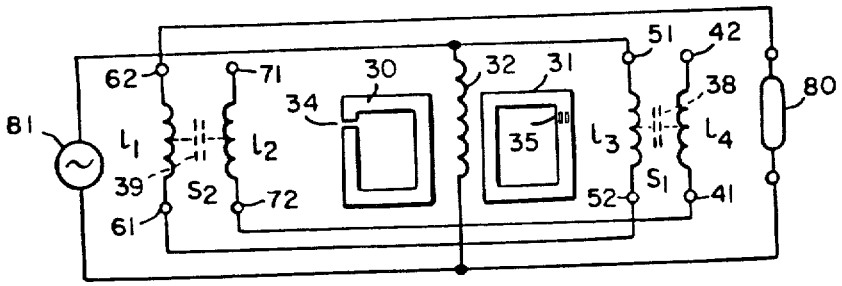

For series impedanace circuits that require an even higher power handling capability and greater flexibility in selecting physical parameters, refer to FIGS. 3B and 4B which show an electrical circuit that combines two series inductor-capacitor devices. These devices are connected in such a manner so as to combine both their respective inductive components and their respective capacitive components. One half of the lamp current is distributed through each of the inductor-capacitor devices. Accordingly, no complicated structure is required to adapt the unit to handle large currents. The use of two iron cores also provides an additional surface area for the radiation of heat that is generated within the unit.

Ordinarily, when two L/C circuits are combined either in series or parallel, one impedance component is increased while the other impedance component is decreased. For example, when two L/C circuits are combined in series, the inductive components are added and their capacitive component is reduced as determined by Kirkoffs law expressed as follows: $C=(C1+C2)/(C1\times C2)$, where C is the resulting capacitance when capacitor C1 and capacitor C2 are connected in series.

In my invention, the circuit is arranged so that the separate capacitive components are in parallel even though each separate unit is a separate series inductance/capacitance element.

Referring specifically to FIG. 4B, an alternating current source 81 induces magnetic flux in iron cores 30 and 31 through a primary wire winding 32. First and second inductor-capacitor windings S1 and S2 are magnetically coupled to the primary winding 32 through the magnetic reluctance path established by the iron cores 30 and 31. In the preferred embodiment, core 30 contains a air gap 34, and core 31 contains an interleaved gap 35. A load 80, e.g. a discharge lamp device, is connected at one terminal thereof to the alternating current source 81, and at the other terminal thereof, to terminal 62 of inductor-capacitor device S2. The respective terminals of each inductor-capacitor unit S1 and S2 are interconnected through terminal pairs 72-41, and 52-61. The circuit is completed by connecting terminal 51 of inductor-capacitor device 45 to the alternating current source 81.

In operation, the inductance of S1 and S2 are provided in series with load 80 as the current of the lamp 80 flows through both devices. The current path is established by interconnection of terminals 61 and 52. Without this interconnection, all current would then flow through terminals 72 and 41, as in prior art devices. The capacitance 38 and 39 which correct the power factor are symbolically represented in phantom in coil S1 and S2, respectively.

The following tables list specific design and operating characteristics for my preferred model.

TABLE I

| | |
|---|---|
| Gap in core 30 | 0.030 inch |
| Gap in core 31 | bridged |
| Primary turns of coil 32 | 200T 19 gage cu. wire |
| Secondary turns unit S2 | 200T 0.00035 al. foil<br>0.0005 mylar |
| Secondary turns unit S1 | 158T 0.00035 al. foil<br>0.0005 mylar |
| Aluminum foil width | 2.5 inches |
| Mylar width | 2.75 inches |
| Resistance Unit S2 | 2.09 ohms |
| Resistance Unit S1 | 1.82 ohms |
| Capacitance Unit S2 | 9.6 uf |
| Capacitance Unit S1 | 7.6 uf |
| Open circuit voltage | 200 volts w/120 volt input |

TABLE II

| with 175 watt MERCURY lamp load | |
|---|---|
| Input voltage | 120 volts |
| Line current | 1.93 amps |
| Lamp current | 1.45 amps |
| Lamp voltage | 136 volts |
| Capacitor voltage | 214 volts |
| Current crest factor | 1.62 |
| Current A1 | 0.65 |
| Current A2 | 0.75 |
| Ambient temperature | 25 degrees C. |
| Stabilized core temp. | 62 degrees C. (core 31)<br>55 degrees C. (core 30) |
| Surface temperature (S1) | 55 degrees C. (top)<br>53 degrees C. (bottom) |
| Surface temperature (S2) | 55 degrees C. (top)<br>54 degrees C. (bottom) |

From the foregoing, it will be appreciated that the invention concerns improvements in inductor-capacitor structures and circuit arrangements that distributes current more uniformly within the improved inductor-capacitor structures. While there have been shown several illustrative embodiments, by way of examples, other arrangements or variations will be obvious to those skilled in the art. Therefore, it is my intent that the appended claims cover all such arrangements and variations as may come within the time spirit of this invention.

What is claimed as new and desired to be secured by Letters Patent of the United States is:

1. An improved inductor-capacitor assembly, which improvement comprises:

at least two elongated strips of thin conducting foil for forming respective input and output windings, at least two elongated strips of dielectric material for separating and insulating the conducting foil, said dielectric material being coated on at least one side thereof with a bonding cement for improving the insulating and dielectric properties of said dielectric material, both said conducting material and said dielectric material being rolled together to form a coil whereby the surfaces of the conducting foil and the dielectric material are in bounded contact with each other thereby to prevent displacement of the foil under electrical and magnetic forces and to seal the dielectric material and conducting foil from their external environment, said coil further including an integral connection terminal disposed on at least one end of each of said input and output windings, each integral terminal being characterized as folded end portions of both the foil and dielectric material, the portions extending substantially parallel to the axis of said windings and being substantially perpendicular to their lengthwise position before being folded, a segment of the end portion being folded over again to sandwich two layers of dielectric material between the folded segment of the conducting foil thereby to produce an integral and durable connection terminal that is reinforced by the dielectric material sandwiched therebetween.

2. The improvement as recited in claim 1 wherein said bonding cement has chemical and dielectric properties substantially similar to the chemical and dielectric properties of the dielectric material for improving the insulating and dielectric properties of the dielectric material.

3. The improvement of claim 1 wherein said dielectric material is composed of mylar.

4. The improvement as recited in claim 1 wherein said inductor-capacitor assembly includes a magnetic core for confining the path of magnetic flux induced therein.

5. An electrical power regulating device, including as a series impedance component, the inductor-capacitor assembly as recited in claim 1, or 2, or 3 or 4.

6. A method of making an improved combination inductor-capacitor assembly of the type including at least two elongated strips of conducting foil that form respective input and output windings, and at least two elongated strips of dielectric material for separating and insulating the input and output windings, which method comprises:

(a) coating at least one side of each of said elongated strips of dielectric material with a thermosetting or thermoplastic bonding cement, (b) placing, alternately, said conducting foil and dielectric material in surface contact thereby to form a layer arrangement whereby respective ones of said conducting strips are separated and insulated from each other, (c) rolling together both said dielectric material and said conducting foil to form a coil, (d) forming a terminal on at least one end of each of said input and output windings by folding over an end portion of both the foil and the dielectric material so that the portions extend substantially perpendicular to their lengthwise position before being folded, folding over again a segment of the folded portion of the foil and dielectric material thereby to sandwich two layers of the dielectric material between the folded segment of the conducting foil thereby to produce an integral and durable connection terminal that is reinforced by the dielectric material sandwiched therebetween, and (e) heating the entire structure to set the thermosetting or thermoplastic bonding cement to seal the dielectric material and conducting foil from its external environment and to rigidly congeal the coil of conducting foils in a rigid structure to prevent relative displacement of the foils under electromagnetic and electrical forces.

7. The method as recited in claim 6 wherein the thermosetting or thermoplastic bonding cement has chemical and dielectric properties substantially similar to the chemical and dielectric properties of the dielectric material.

8. An inductor-capacitor assembly produced by the method recited in claim 6 or 7.

* * * * *